US007050731B2

(12) United States Patent
Bannai et al.

(10) Patent No.: US 7,050,731 B2
(45) Date of Patent: May 23, 2006

(54) IMAGE FORMING APPARATUS INCLUDING TRANSFER BELT HAVING UNEVEN THICKNESS AND POSITION SHIFT DETECTION AND CORRECTION METHOD

(75) Inventors: Kazunori Bannai, Tokyo (JP); Kozo Yamazaki, Kamakura (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 10/805,235

(22) Filed: Mar. 22, 2004

(65) Prior Publication Data

US 2004/0184828 A1 Sep. 23, 2004

(30) Foreign Application Priority Data

Mar. 20, 2003 (JP) ..... 2003-078946

(51) Int. Cl.
*G03G 15/00* (2006.01)

(52) U.S. Cl. ..... 399/49; 399/303; 399/66; 347/116

(58) Field of Classification Search ..... 399/49, 399/66, 301, 302, 303, 308; 347/115, 116
See application file for complete search history.

(56) References Cited

U.S. PATENT DOCUMENTS 3,902,801 A * 9/1975 Lehman ..... 399/39
5,224,693 A 7/1993 Taguchi et al.
5,227,842 A 7/1993 Hayashi et al.
5,255,904 A 10/1993 Taguchi et al.
5,270,783 A 12/1993 Bisaiji et al.
5,297,376 A 3/1994 Taguchi et al.
5,325,213 A 6/1994 Takahashi et al.
5,390,033 A 2/1995 Bannai et al.
5,471,277 A 11/1995 Fujioka et al.
5,515,145 A * 5/1996 Sasaki et al. ..... 399/302
5,579,092 A * 11/1996 Isobe et al. ..... 399/39
5,583,607 A 12/1996 Fujioka et al.
5,583,662 A 12/1996 Takahashi et al.
5,610,720 A 3/1997 Fujioka et al.
5,682,227 A 10/1997 Taguchi et al.
5,689,348 A 11/1997 Takahashi et al.
5,768,671 A 6/1998 Komiya et al.
5,778,280 A * 7/1998 Komiya et al. ..... 399/49
5,847,845 A 12/1998 Takahashi et al.
5,852,461 A * 12/1998 Noguchi ..... 347/116
5,889,547 A * 3/1999 Rombult et al. ..... 347/262

(Continued)

FOREIGN PATENT DOCUMENTS

EP 0 999 479 5/2000

*Primary Examiner*—Diego Gutierrez
*Assistant Examiner*—Travis Reis
(74) *Attorney, Agent, or Firm*—Oblon, Spivak, McClelland, Maier & Neustadt, P.C.

(57) ABSTRACT

An image forming apparatus includes at least one image carrier. An endless transfer belt directly or indirectly receives toner images and pattern toner images from the image carrier and is spanned around and surrounds a drive roller and driven rollers. A position shift detector detects positions of pattern toner images formed on the image carrier. Pattern toner images are formed on the image carrier at an interval of 1/N of a circumferential length of the image carrier, where N is an integer equal to or greater than 1. The pattern toner images are transferred from the image carrier onto the transfer belt over one cycle length of the transfer belt. The position shift detector detects positions of the pattern toner images to obtain position shift data. Moving average values of N number of the position shift data are calculated.

33 Claims, 8 Drawing Sheets

U.S. PATENT DOCUMENTS 6,002,413 A * 12/1999 Nishizawa et al. ..... 347/116
6,038,423 A 3/2000 Tagawa et al.
6,075,624 A 6/2000 Bannai et al.
6,118,463 A * 9/2000 Houki et al. ..... 347/116
6,151,057 A 11/2000 Yamazaki et al.
6,154,628 A * 11/2000 Kawano ..... 399/301
6,185,402 B1 * 2/2001 Linssen ..... 399/301
6,198,896 B1 * 3/2001 Nakayasu et al. ..... 399/301
6,452,147 B1 9/2002 Inada
6,697,092 B1 2/2004 Bannai
6,829,465 B1 * 12/2004 Yamanaka et al. ..... 399/301
2001/0031148 A1 10/2001 Kajiwara et al.
2005/0047834 A1 * 3/2005 Tomita et al. ..... 399/301

* cited by examiner

IMAGE FORMING APPARATUS INCLUDING TRANSFER BELT HAVING UNEVEN THICKNESS AND POSITION SHIFT DETECTION AND CORRECTION METHOD

CROSS-REFERENCE TO RELATED APPLICATIONS

This application claims priority to Japanese patent application no. 2003-078946 filed in the Japanese Patent Office on Mar. 20, 2003, the disclosure of which is incorporated by reference herein in its entirety.

BACKGROUND OF THE INVENTION

1. Field of the Invention

The present invention relates to an image forming apparatus which forms a multi-color image by transferring toner images of different colors formed on at least one image carrier onto an endless transfer belt while superimposing thereon and then transferring a superimposed color toner image from the transfer belt onto a recording medium, or by transferring toner images of different colors from at least one image carrier onto a recording medium carried and conveyed on an endless transfer belt. The present invention also relates to a position shift detection and correction method for detecting and correcting a position shift in a color toner image formed on a transfer belt or a recording medium carried and conveyed on the transfer belt caused by an uneven thickness of the transfer belt.

2. Discussion of the Related Art

In an image forming apparatus, such as, a copying machine, a printer, a facsimile machine, a multifunctional image forming apparatus, or other similar image forming apparatuses, a multi-color image is generally formed on a recording medium, such as, a transfer sheet, by the following process: forming toner images of different colors on at least one image carrier; transferring the toner images from the at least one image carrier onto an endless transfer belt while superimposing thereon and then transferring a superimposed color toner image from the transfer belt onto a recording medium, or transferring the toner images of different colors from the at least one image carrier onto a recording medium carried and conveyed on a transfer belt; and fixing the color toner image on the recording medium. In such an image forming apparatus, positions of transferred toner images are shifted on a transfer belt or a recording medium carried and conveyed on a transfer belt due to a speed variation of the transfer belt. As a result, a color shift (color misregistration) occurs in a color toner image, thereby deteriorating image quality.

In order to solve the above-described color shift problem, a speed variation of a transfer belt is detected while measuring a surface velocity of the transfer belt. The rotational speed of a motor, which drives a drive roller that drives the transfer belt to rotate, is controlled in real time based on the detection result of the speed variation of the transfer belt such that the surface velocity of the transfer belt remains constant.

Generally, the speed variation of the transfer belt is caused by an uneven thickness of the transfer belt in its circumferential direction, a speed variation of an image carrier that rotates while contacting the transfer belt, a speed variation of a drive roller that drives the transfer belt to rotate, and the like. Thus, when the speed variation of the transfer belt is detected by measuring the surface velocity of the transfer belt, the speed variation of the transfer belt includes an uneven thickness component of the transfer belt, a speed variation component of the image carrier, and a speed variation component of the drive roller. Therefore, the speed variation of the transfer belt changes every rotation cycle. In this condition, it is required that the speed variation of the transfer belt be detected every time an image forming operation is performed and that the rotational speed of the drive roller for driving the transfer belt be controlled based on the detection result. Such speed control of the drive roller requires very precise control and parts manufactured to a high degree of accuracy, which increases a cost of using the speed control.

If only a speed variation component of a transfer belt caused by an uneven thickness of the transfer belt can be determined and detected while eliminating, for example, a speed variation component of an image carrier and a speed variation component of a drive roller, the rotational speed of the drive roller can be set such that the speed of the transfer belt becomes constant based on the detection result of one time detection operation for the speed variation of the transfer belt. In this case, a speed control of the drive roller can be performed in a simple manner. However, such control is not known in the art.

Published Japanese patent application No. 10-186787 proposes a technique in which only a speed variation component caused by an uneven thickness of a transfer belt is determined by performing a low-pass filter processing. However, a specific construction and method are not described.

Therefore, it is desirable to provide an image forming apparatus that detects and corrects a position shift in a color toner image formed on a transfer belt or a recording medium carried and conveyed on the transfer belt according to an uneven thickness of the transfer belt.

It is further desirable to provide a position shift detection and correction method for detecting and correcting a position shift in a color toner image formed on a transfer belt or a recording medium carried and conveyed on the transfer belt according to an uneven thickness of the transfer belt.

SUMMARY OF THE INVENTION

According to an aspect of the present invention, an image forming apparatus includes at least one image carrier configured to carry toner images and pattern toner images thereon, and an endless transfer belt configured to one of directly and indirectly receive the toner images and the pattern toner images from the at least one image carrier. The transfer belt is spanned around and surrounds a drive roller configured to drive the transfer belt to rotate and at least one driven roller. The image forming apparatus further includes a position shift detector configured to detect positions of pattern toner images formed on the at least one image carrier. Assuming that N is an integer equal to or greater than 1, pattern toner images can be formed on the at least one image carrier at an interval of 1/N of a circumferential length of the at least one image carrier, the pattern toner images can be transferred from the at least one image carrier onto the transfer belt over one cycle length of the transfer belt, the position shift is detector is configured to detect positions of the pattern toner images to obtain position shift data, and moving average values of N number of the position shift data can be calculated.

According to another aspect of the present invention, an image forming apparatus includes at least one image carrier configured to carry toner images and pattern toner images thereon, and an endless transfer belt configured to one of directly and indirectly receive the toner images and the pattern toner images from the at least one image carrier. The transfer belt is spanned around and surrounds a drive roller configured to drive the transfer belt to rotate and at least one driven roller. The image forming apparatus further includes a position shift detector configured to detect positions of pattern toner images formed on the at least one image carrier. Assuming that M is an integer equal to or greater than 1, pattern toner images can be formed on the at least one image carrier at an interval of 1/M of a circumferential length of a circle having a diameter equal to a length in which an average thickness of the transfer belt is added to a diameter of the drive roller, the pattern toner images can be transferred from the at least one image carrier onto the transfer belt over one cycle length of the transfer belt, the position shift detector is configured to detect positions of the pattern toner images to obtain position shift data, and moving average values of M number of the position shift data can be calculated.

According to another aspect of the present invention, an image forming apparatus includes at least one image carrier configured to carry toner images and pattern toner images thereon, and an endless transfer belt configured to one of directly and indirectly receive the toner images and the pattern toner images from the at least one image carrier. The transfer belt is spanned around and surrounds a drive roller configured to drive the transfer belt to rotate and at least one driven roller. The image forming apparatus further includes a position shift detector configured to detect positions of pattern toner images formed on the at least one image carrier. Assuming that each of N, M, and n is an integer equal to or greater than 1, a ratio between a circumferential length of the at least one image carrier and a circumferential length of a circle having a diameter equal to a length in which an average thickness of the transfer belt is added to a diameter of the drive roller is set to N:M, pattern toner images can be formed on the at least one image carrier at an interval of 1/n×N of the circumferential length of the at least one image carrier, the pattern toner images can be transferred from the at least one image carrier onto the transfer belt over one cycle length of the transfer belt, the position shift detector is configured to detect positions of the pattern toner images to obtain position shift data, first moving average values of n×N number of the position shift data can be calculated, and then second moving average values of n×M number of the first moving average values can be calculated.

According to yet another aspect of the present invention, a position shift detection and correction method for detecting and correcting a position shift in a color toner image formed on one of a transfer belt and a recording medium carried and conveyed on the transfer belt according to an uneven thickness of the transfer belt includes forming pattern toner images on at least one image carrier at an interval of 1/N of a circumferential length of the at least one image carrier, where N is an integer equal to or greater than 1. The pattern toner images are transferred from the at least one image carrier onto the transfer belt over one cycle length of the transfer belt. Positions of the pattern toner images are detected to obtain position shift data. Moving average values of N number of the position shift data are calculated. A rotational speed of a drive roller that drives the transfer belt to rotate is controlled based on the calculated moving average values.

According to yet another aspect of the present invention, a position shift detection and correction method for detecting and correcting a position shift in a color toner image formed on one of a transfer belt and a recording medium carried and conveyed on the transfer belt according to an uneven thickness of the transfer belt includes forming pattern toner images on at least one image carrier at an interval of 1/M of a circumferential length of a circle having a diameter equal to a length in which an average thickness of the transfer belt is added to a diameter of a drive roller that drives the transfer belt to rotate, where M is an integer equal to or greater than 1. The pattern toner images are transferred from the at least one image carrier onto the transfer belt over one cycle length of the transfer belt. Positions of the pattern toner images are detected to obtain position shift data. Moving average values of M number of the position shift data are calculated. A rotational speed of the drive roller is controlled based on the calculated moving average values.

According to yet another aspect of the present invention, a position shift detection and correction method for detecting and correcting a position shift in a color toner image formed on one of a transfer belt and a recording medium carried and conveyed on the transfer belt according to an uneven thickness of the transfer belt includes setting a ratio between a circumferential length of at least one image carrier and a circumferential length of a circle having a diameter equal to a length in which an average thickness of the transfer belt is added to a diameter of a drive roller that drives the transfer belt to rotate to N:M, where each of N, M is an integer equal to or greater than 1. Pattern toner images are formed on the at least one image carrier at an interval of 1/n×N of the circumferential length of the at least one image carrier, where n is an integer equal to or greater than 1. The pattern toner images are transferred from the at least one image carrier onto the transfer belt over one cycle length of the transfer belt. Positions of the pattern toner images are detected to obtain position shift data. First moving average values of n×N number of the position shift data are calculated. Second moving average values of n×M number of the first moving average values are calculated. A rotational speed of the drive roller is controlled based on the calculated second moving average values.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
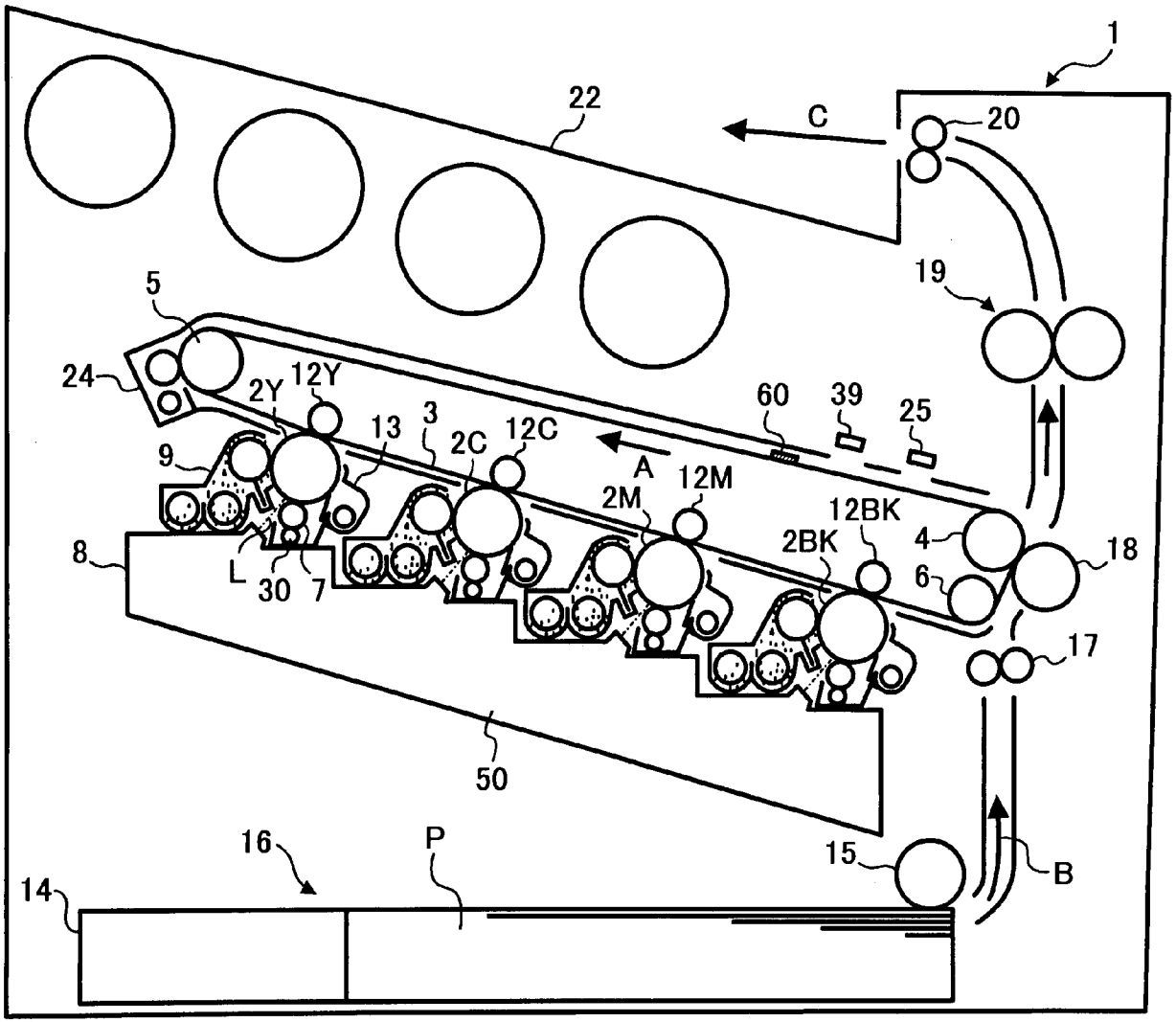
FIG. 1 is a schematic vertical cross sectional view of an exemplary image forming apparatus according to an embodiment of the present invention.

Preferred embodiments of the present invention are described in detail referring to the drawings, wherein like reference numerals designate identical or corresponding parts throughout the several views.

FIG. 1 is a schematic vertical cross sectional view of an exemplary image forming apparatus that forms a full-color image according to one embodiment of the present invention. A main body 1 of the image forming apparatus includes four image carriers 2Y, 2C, 2M, 2BK including drum-shaped photoreceptors, and a transfer belt 3 of an endless belt. Toner images are formed on the respective surfaces of the image carriers 2Y, 2C, 2M, 2BK while rotating the image carriers 2Y, 2C, 2M, 2BK in a clockwise direction in FIG. 1 (details of which are described later). The transfer belt 3 is spanned around and surrounds a drive roller 4 and driven rollers 5 and 6, and is driven to rotate in a direction indicated by arrow (A) in FIG. 1. The transfer belt 3 abuts the image carriers 2Y, 2C, 2M, 2BK. Toner images of respective colors formed on the image carriers 2Y, 2C, 2M, 2BK are transferred onto the transfer belt 3 such that the images are superimposed on one another.

The structure for forming toner images on the image carriers 2Y, 2C, 2M, 2BK and for transferring the toner images onto the transfer belt 3 are substantially the same as one another except that the image carriers 2Y, 2C, 2M, 2BK form toner images of different colors. Therefore, the structure for forming a yellow toner image on the image carrier 2Y and for transferring the yellow toner image onto the transfer belt 3 will be described as a representative example.

Figure 2:
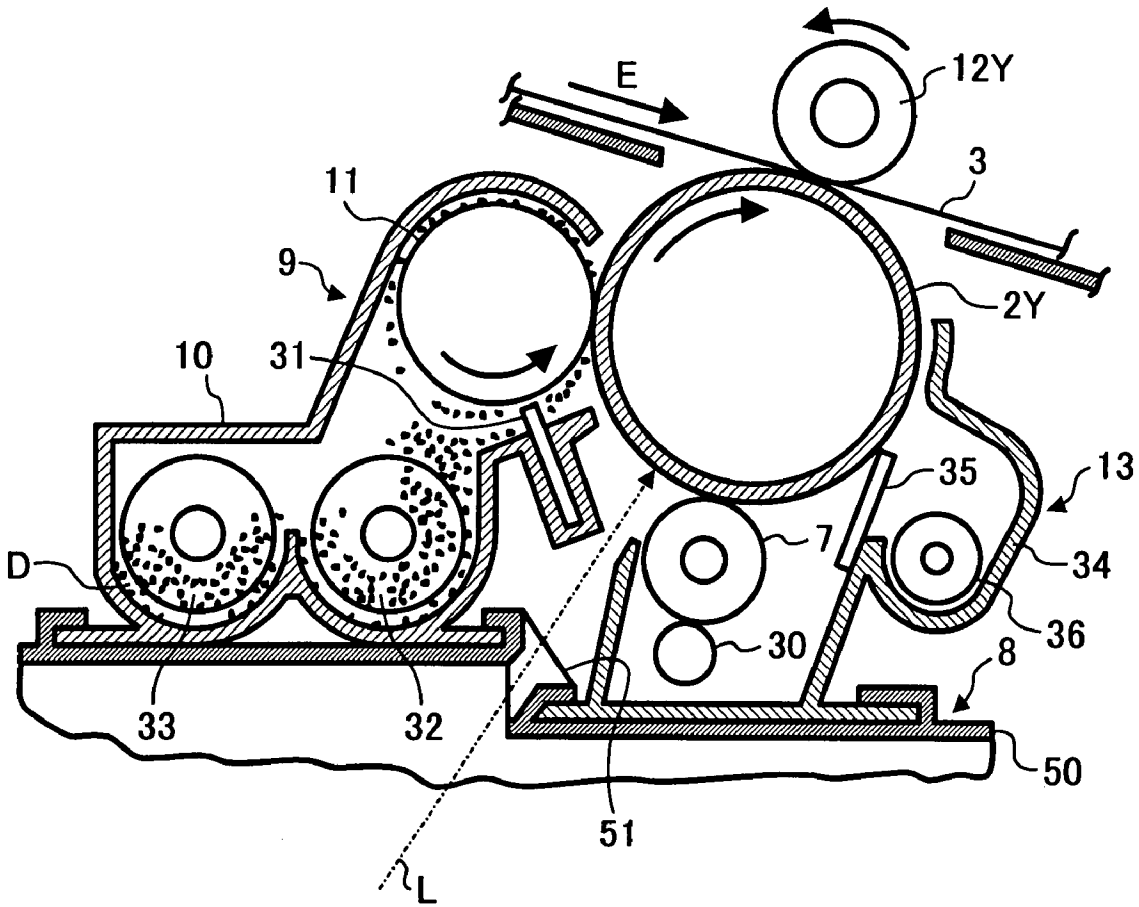
FIG. 2 is a detail view of a portion of the image forming apparatus of FIG. 1.

FIG. 2 is a detail enlarged view of the image carrier 2Y and components provided around the image carrier 2Y. The image carrier 2Y is driven to rotate in a clockwise direction in FIG. 2. A charging device including a charging roller 7, to which a charging voltage is applied, charges the image carrier 2Y with a predetermined polarity or charge. A cleaning roller 30 contacts the charging roller 7 to clean the surface of the charging roller 7. The surface of the image carrier 2Y uniformly charged by the charging roller 7 is exposed to a light-modulated laser beam (L) emitted from a laser writing device 8 (also shown in FIG. 1). Thereby, an electrostatic latent image of a yellow image is formed on the surface of the image carrier 2Y. A developing device 9 develops the electrostatic latent image on the image carrier 2Y with yellow toner and forms a yellow toner image.

The laser writing device 8 includes optical elements (not shown), such as, a laser light source, a polygonal mirror, a F∘θ lens, etc., disposed in a case 50. The laser beam (L) is emitted through a light emitting opening 51 formed in the case 50. The laser writing device 8 may use a light-emitting diode.

As shown in FIG. 2, the developing device 9 includes a developing case 10, a developing roller 11, a developing blade 31, and first and second conveying screws 32 and 33. The developing case 10 accommodates a dry-type developer (D). The developing roller 11 is rotatably supported by the developing case 10 and is arranged adjacent to and opposite to the image carrier 2Y through an opening formed in the developing case 10. The developing blade 31 regulates an amount of the developer (D) on the surface of the developing roller 11. The first and second conveying screws 32 and 33 are provided opposite to the developing roller 11. The developer (D) in the developing case 10 is conveyed by the first and second conveying screws 32 and 33 while being agitated, and is then carried on the developing roller 11 that is rotated in a direction indicated by arrow in FIG. 2. At this time, the developing blade 31 regulates a height of the developer (D) on the developing roller 11. Subsequently, when the regulated developer (D) is carried to a developing area between the developing roller 11 and the image carrier 2Y, the toner in the developer (D) is electrostatically attracted to an electrostatic latent image formed on the surface of the image carrier 2Y. Thereby, the electrostatic latent image is visualized as a yellow toner image. Either a one-component developer including a toner or a two-component developer including a toner and carrier may be used as the developer (D). In a preferred embodiment, the developer (D) is a two-component developer.

A primary transfer roller 12Y is arranged opposite to the image carrier 2Y via the transfer belt 3. A toner image on the image carrier 2Y is transferred onto the transfer belt 3, which is rotated in a direction indicated by arrow (E) in FIG. 2, by applying a transfer voltage to the primary transfer roller 12Y. A cleaning device 13 removes a residual toner from the surface of the image carrier 2Y.

The cleaning device 13 includes a cleaning case 34, a cleaning blade 35, and a waste toner conveying screw 36. The cleaning case 34 includes an opening on the side facing the image carrier 2Y. The base end portion of the cleaning blade 35 is fixed to the cleaning case 34, and the leading edge portion of the cleaning blade 35 abuts the surface of the image carrier 2Y to remove a residual toner from the surface of the image carrier 2Y. The waste toner conveying screw 36 conveys the toner removed by the cleaning blade 35 to a waster toner bottle (not shown). A charging voltage including an alternating current voltage superimposed on a direct current voltage is applied to the charging roller 7. Therefore, when the image carrier 2Y, which has passed the cleaning device 13, passes the charging roller 7, the surface of the image carrier 2Y is uniformly discharged and charged at the same time to be prepared for a next image forming operation.

As in the case of the image carrier 2Y, a cyan toner image, a magenta toner image, and a black toner image are formed on the image carriers 2C, 2M, 2BK illustrated in FIG. 1, respectively. The cyan toner image, the magenta toner image, and the black toner image are sequentially transferred onto the transfer belt 3 and superimposed on the yellow toner image which has been already transferred onto the transfer belt 3. As a result, a superimposed color toner image is formed on the transfer belt 3. As illustrated in FIG. 1, image forming elements, which have similar functions to those provided around the image carrier 2Y, are provided around the image carriers 2C, 2M, 2BK, respectively. In FIG. 1, primary transfer rollers for transferring a cyan toner image, a magenta toner image, and a black toner image from the image carriers 2C, 2M, and 2BK onto the transfer belt 3, respectively, are indicated by the reference characters 12C, 12M, 12BK.

At the lower part of the main body 1 of the image forming apparatus, there are provided a sheet feeding cassette 14 and a sheet feeding device 16 including a sheet feeding roller 15. The sheet feeding cassette 14 accommodates recording media (P), such as transfer sheets. An uppermost recording medium (P) is fed from the sheet feeding cassette 14 in a direction indicated by arrow (B) in FIG. 1 by rotating the sheet feeding roller 15. The recording medium (P) fed from the sheet feeding cassette 14 is conveyed to a nip part between the transfer belt 3 stretched around and surrounding the drive roller 4 and a secondary transfer roller 18 by a pair of registration rollers 17 at an appropriate timing. At this time, by the application of a predetermined transfer voltage to the secondary transfer roller 18, a toner image on the transfer belt 3 is secondarily transferred onto the recording medium (P).

The recording medium (P) with a toner image secondarily transferred thereon is conveyed upward to a fixing device 19. While the recording medium (P) passes through the fixing device 19, the toner image is fixed to the recording medium (P) by the action of heat and pressure.

Subsequently, the recording medium (P) is discharged in the direction indicated by arrow (C) in FIG. 1, and stacked on a sheet discharging section 22 constructed of an upper wall of the main body 1 of the image forming apparatus by a pair of sheet discharging rollers 20. A cleaning device 24 removes the residual toner from the transfer belt 3.

A thickness of the transfer belt 3 may not even in a circumferential direction of the belt 3. For example, a transfer belt manufactured by a so-called centrifugal molding method, which involves casting and sintering a raw material solution in a rotary mold, tends to have an uneven thickness in its circumferential direction due to limitations inherent in the manufacturing method. This uneven thickness does not uniformly repeat increases and decreases in thickness, but often appears in a sinusoidal wave in one turn in the circumferential direction.

If the transfer belt 3 has the above-described uneven thickness, the surface velocity of the transfer belt 3 cyclically varies when the transfer belt 3 is driven to rotate. As described above, the image carriers 2Y, 2C, 2M, 2BK and the drive roller 4 contact the transfer belt 3. If the surface velocities of the image carriers 2Y, 2C, 2M, 2BK and the drive roller 4 vary due to their eccentricities, the surface velocity of the transfer belt 3 varies. When toner images of different colors are transferred onto the surface of the transfer belt 3 while being each superimposed thereon without eliminating the speed variation of the transfer belt 3, a color shift (color misregistration) occurs in a superimposed color toner image, thereby deteriorating image quality.

As described above, in the known process, in order to solve the above-described color shift problem, a speed variation of a transfer belt is detected while measuring a surface velocity of the transfer belt. The rotational speed of a drive roller, which drives the transfer belt to rotate, is controlled based on the detection result of the speed variation of the transfer belt such that the surface velocity of the transfer belt remains constant. In this technique, the control operation may not be performed in a simple manner.

Accordingly, the image forming apparatus according to the present invention accurately detect amounts of shift positions (hereinafter simply referred to as shift position amounts) of color toner images formed on the transfer belt 3 caused by the uneven thickness of the transfer belt 3 and corrects shift positions of the color toner images based on the detection result in a simple manner.

One exemplary method of detecting shift position amounts of color toner images formed on the transfer belt 3 while eliminating the influence of the speed variations of the image carriers 2Y, 2C, 2M, 2BK will be described.

Assuming that N is an integer equal to or greater than 1, pattern toner images are formed on the surface of, for example, the first image carrier 2Y at an interval of 1/N of the circumferential length of the image carrier 2Y. Specifically, the laser writing device 8 forms electrostatic latent images for pattern toner images on the surface of the image carrier 2Y at an equal time interval corresponding to the interval of 1/N of the circumferential length of the image carrier 2Y. The pattern toner images are formed by the image forming method described with reference to FIGS. 1 and 2. For example, when the N is 8, eight pattern toner images are formed on the circumferential surface of the image carrier 2Y at equal intervals during one rotation of the image carrier 2Y. Such pattern toner images are transferred from the image carrier 2Y onto the transfer belt 3 over one cycle length of the transfer belt 3 by the primary transfer roller 12Y illustrated in FIGS. 1 and 2. When the pattern toner images are transferred from the image carrier 2Y to the transfer belt 3, the secondary transfer roller 18 is away from the surface of the transfer belt 3.

Figure 3:
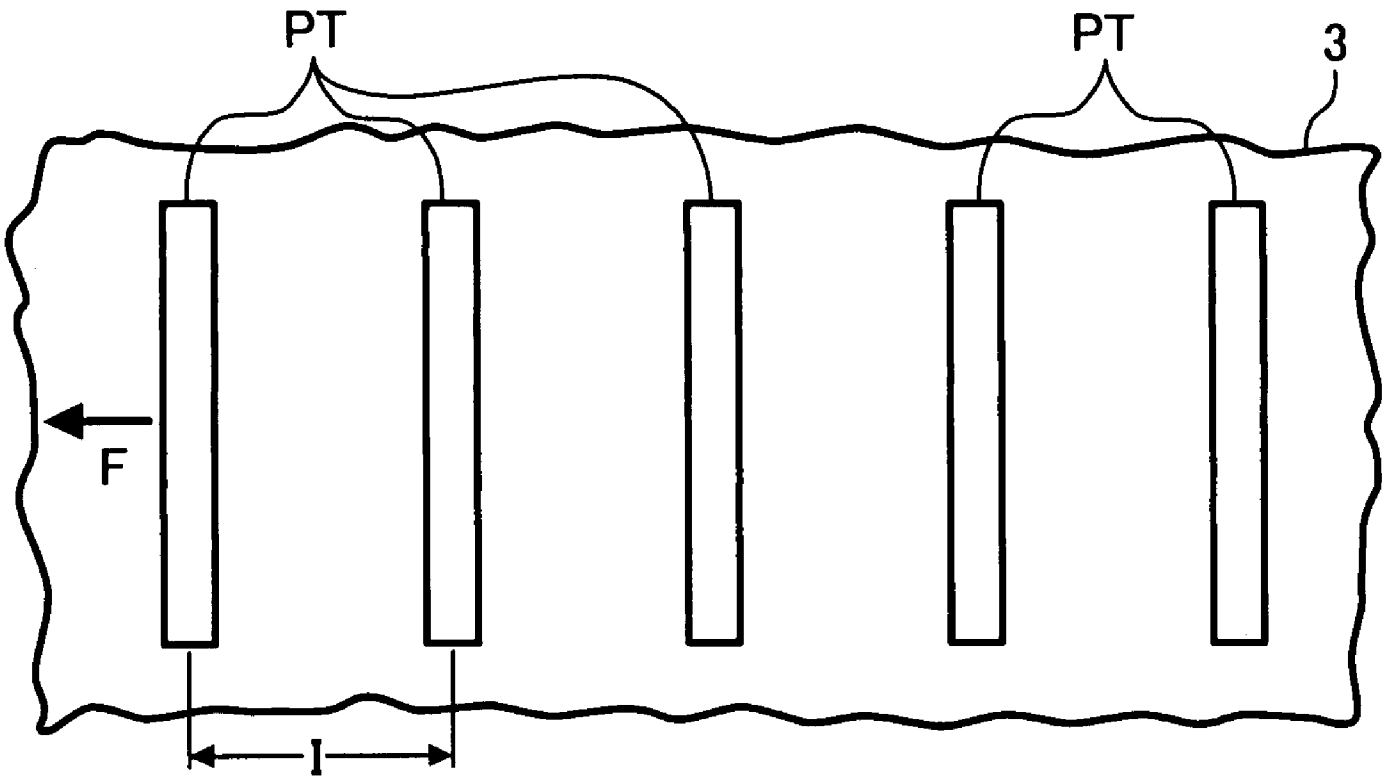
FIG. 3 is a schematic illustration showing pattern toner images transferred onto a transfer belt.

FIG. 3 is a schematic illustration showing pattern toner images (PT) transferred onto the transfer belt 3 at intervals (I). An arrow indicated by a reference character (F) is a moving direction of the transfer belt 3. A position shift sensor 25 illustrated in FIG. 1, which includes, for example, a photosensor, detects positions of the pattern toner images (PT), and thereby position shift data is obtained. The position shift sensor 25 is provided downstream of the drive roller 4 in the direction in which the transfer belt 3 is rotated. Specifically, assuming that the circumferential length of the image carrier 2Y is S, pattern toner images are formed on the surface of the image carrier 2Y at equal intervals such that each interval between the pattern toner images on the image carrier 2Y becomes S/N. Further, the pattern toner images are transferred from the image carrier 2Y to the transfer belt 3 such that the each interval (I) between the pattern toner images (PT) on the transfer belt 3 becomes equal. However, in reality, the positions of the pattern toner images (PT) transferred onto the transfer belt 3 are shifted due to the speed variation of the image carrier 2Y, the uneven thickness of the transfer belt 3, etc. As a result, the interval (I) is different from a reference (theoretical) interval, and the intervals (I) become different from each other.

Figure 4:
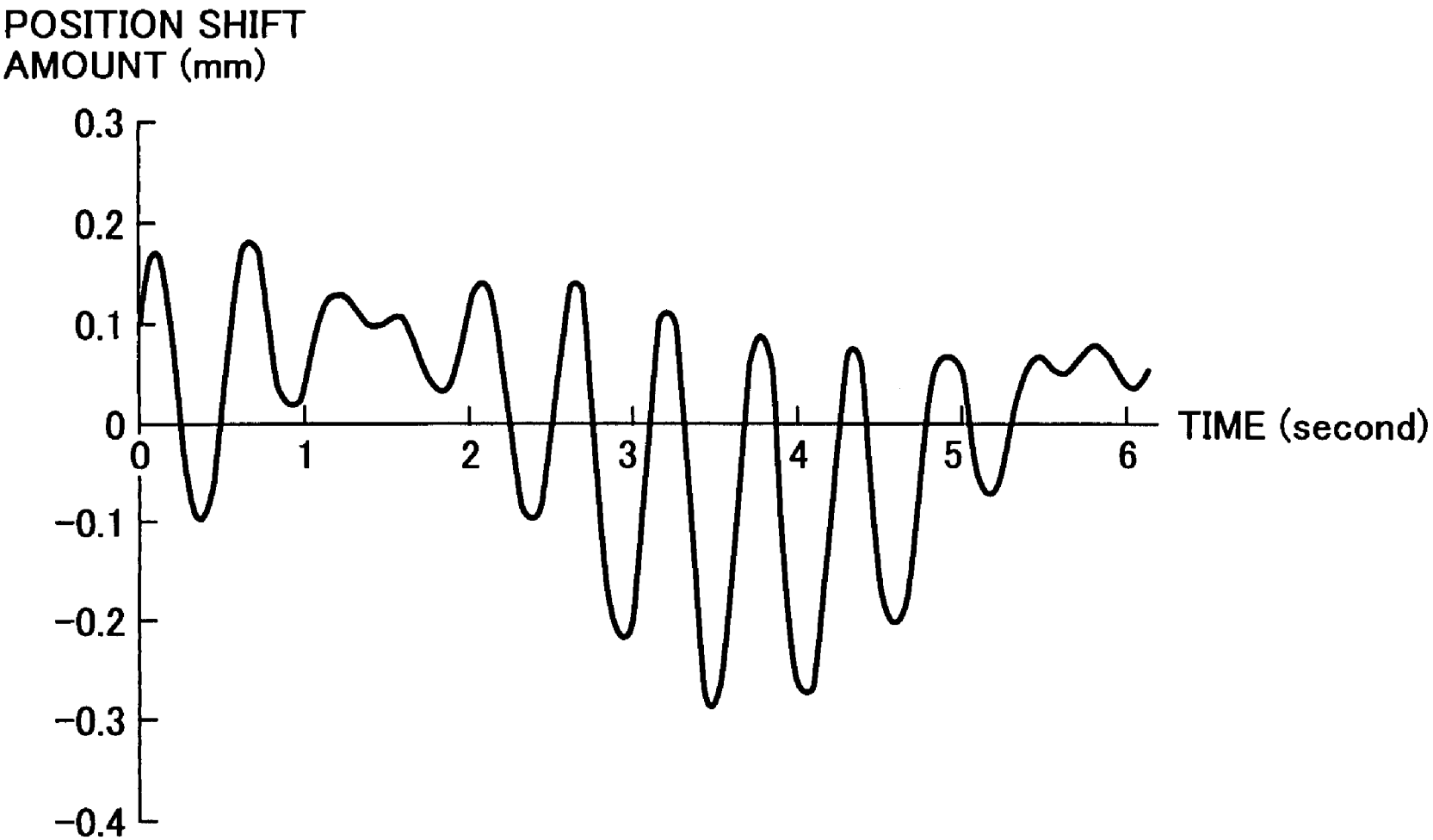
FIG. 4 is a graph showing an example of position shift amounts obtained by detecting pattern toner images by a position shift sensor.

The exemplary position shift data obtained based on the detection result of the position shift sensor 25 is shown in FIG. 4. FIG. 4 is a graph showing an example of position shift amounts obtained by detecting the pattern toner images (PT) by the position shift sensor 25. The pattern toner images (PT) are detected by the position shift sensor 25, and calculated position shift amounts are plotted with respect to the time over one cycle of the transfer belt 3. The exemplary position shift data was obtained under the following conditions:

(Transfer belt per one rotation (cycle))

| | | |
|---|---|---|
| Peripheral length: | 800 | mm |
| Frequency: | 0.194 | fHz |
| Linear velocity: | 155 | mm/second |
| Amplitude: | 0.1 | mm |

(Image carrier per one rotation)

| | | |
|---|---|---|
| Diameter: | 30 | mm |
| Frequency: | 1.644 | fHz |
| Linear velocity: | 155 | mm/second |
| Amplitude: | 0.1 | mm |

(Belt driving roller per one rotation)

| | | |
|---|---|---|
| Diameter: | 26.25 | mm |
| Frequency: | 1.88 | fHz |
| Linear velocity: | 155 | mm/second |
| Amplitude: | 0.1 | mm |

In the speed variation per one cycle (rotation) of the transfer belt 3, the speed variation component caused by the uneven thickness of the transfer belt 3 has a longer-term variation than the speed variation component of the image carrier. Therefore, data from which the speed variation component of the image carrier is eliminated is obtained by calculating the moving average of the position shift data shown in FIG. 4 while performing a low-pass filter processing.

For example, there are two methods, i.e., a one-side (left-side or right-side) average method and a center average method, for calculating the moving average value of the position shift data. Specifically, when calculating the moving average value of two position shift data at a timing t by the one-side average method, a one-side (left-side) average value is obtained by the calculation of (Xt−1+Xt)/2, and a one-side (right-side) average value is obtained by the calculation of (Xt+Xt+1)/2. Further, when calculating the moving average value of three position shift data at a timing t by the one-side average method, a one-side (left-side) average value is obtained by the calculation of (Xt−2+Xt−1+Xt)/3, and a one-side (right-side) average value is obtained by the calculation of (Xt+Xt+1+Xt+2)/3.

When calculating the moving average value of three (i.e., uneven number) position shift data at a timing t by the center average method, a center average value is obtained by the calculation of (Xt−1+Xt+Xt+1)/3. Further, when calculating the moving average value of four (i.e., even number) position shift data at a timing t by the center average method, a center average value is obtained by the calculation of (0.5×Xt−2+Xt−1+Xt+Xt+1+0.5×Xt+2)/4. In this case, both end position shift data are reduced by one-half, respectively.

As described above, there are two methods, i.e., a one-side (left-side or right-side) average method and a center average method, for calculating the moving average value of the position shift data. If a moving average value is calculated by the one-side average method, the phase of the data subjected to a low-pass filter processing is shifted. In this case, a calculation for returning phase is required, thereby deteriorating accuracy. For this reason, it is preferable that the moving average values of position shift data be calculated by the center average method.

Examples of calculating the moving average values of 2, 3, and 4 position shift data are described above. In the image forming apparatus of the present embodiment, moving average values of N number of position shift data are calculated over at least one cycle of the transfer belt 3. N equals the number of pattern toner images formed on the image carrier 2Y during its one rotation.

Exemplary calculation of moving average values of N number (e.g., 4) of position shift data by the center average method is represented below.

Assuming that position shift data are D1, D2, D3, D4 . . . DX, and a moving average value is d, moving average values are calculated over at least one cycle of the transfer belt 3 as follows.

$$d3=(0.5\times D1+D2+D3+D4+0.5\times D5)/4$$

$$d4=(0.5\times D2+D3+D4+D5+0.5\times D6)/4$$

$$d5=(0.5\times D3+D4+D5+D6+0.5\times D7)/4$$

$$d6=(0.5\times D4+D5+D6+D7+0.5\times D8)/4$$

$$d7=(0.5\times D5+D6+D7+D8+0.5\times D9)/4$$

.

.

.

By the above-described calculation, position shift data from which a speed variation component of the image carrier 2Y is eliminated are calculated by a low-pass processing. By controlling the rotational speed of the drive roller 4 based on the calculated position shift data (i.e., the moving average values . . . d3, d4, d5, d6, d7 . . . ), the speed variation of the transfer belt 3 can be corrected. In the above exemplary calculation of moving average values of N number (e.g., 4) of position shift data by the center average method, 5 position shift data are divided by 4. However, because both end position shift data are reduced by one-half, respectively, the above-described 5 position shift data are considered as 4 position shift data in total. This applies to all cases when the N number is an even number.

Figure 5:
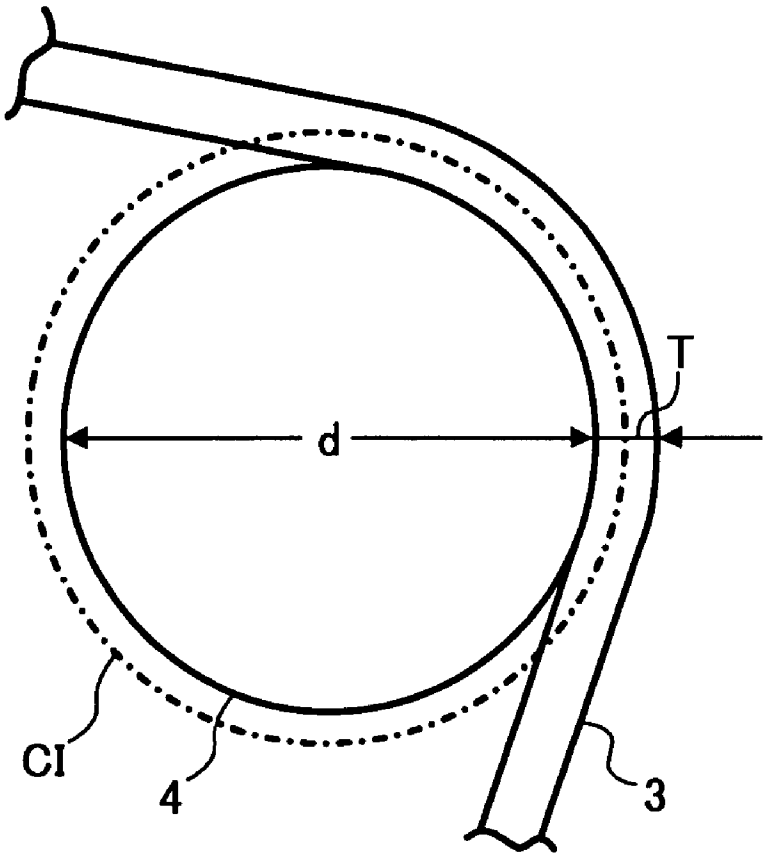
FIG. 5 is a schematic view of a drive roller and a transfer belt wrapped around the drive roller.

In the image forming apparatus of the present embodiment, position shift data from which a speed variation component of the drive roller 4 is eliminated are calculated as follows. FIG. 5 is a schematic view of the drive roller 4 and the transfer belt 3 wrapped around and surrounding the drive roller 4. In FIG. 5, a circle (CI) indicated by a dashed line has a diameter equal to a length in which an average thickness (T) is added to the diameter (d) of the drive roller 4 that drives the transfer belt 3. Assuming that M is an integer equal to or greater than 1, pattern toner images are formed, for example, on the image carrier 2Y at an interval of 1/M of a circumferential length of the circle (CI). The pattern toner images are transferred from the image carrier 2Y onto the transfer belt 3 over one cycle length of the transfer belt 3. Then, the position shift sensor 25 detects positions of the pattern toner images (PT) on the transfer belt 3 to obtain position shift data. Further, moving average values of M number of position shift data are calculated over at least one cycle of the transfer belt 3. M equals the number of pattern toner images formed on the image carrier 2Y during its one rotation.

Exemplary calculation of moving average values of M number (e.g., 3) of position shift data by the center average method is represented below.

Assuming that position shift data are E1, E2, E3, E4 . . . EX, and a moving average value is e, moving average values are calculated over at least one cycle of the transfer belt 3 as follows.

$$e2=(E1+E2+E3)/3$$

$$e3=(E2+E3+E4)/3$$

$$e4=(E3+E4+E5)/3$$

$$e5=(E4+E5+E6)/3$$

$$e6=(E5+E6+E7)/3$$

.

.

By the above-described calculation, position shift data from which a speed variation component of the drive roller 4 is eliminated are calculated by a low-pass processing. By controlling the rotational speed of the drive roller 4 based on the calculated position shift data (i.e., the moving average values . . . e2, e3, e4, e5, e6 . . . ), the speed variation of the transfer belt 3 can be corrected.

Further, in the image forming apparatus of the present embodiment, position shift data from which speed variation components of the image carrier and the drive roller 4 are eliminated are calculated as follows.

Assuming that each of N, M and n is an integer equal to or greater than 1, a ratio between a circumferential length of, for example, the image carrier 2Y and the circumferential length of the circle (CI) illustrated in FIG. 5 having a diameter equal to a length in which the average thickness (T) of the transfer belt 3 is added to the diameter of the drive roller 4 is set to N:M. Then, pattern toner images are formed on the image carrier 2Y at an interval of 1/n×N of the circumferential length of the image carrier 2Y, and the pattern toner images are transferred from the image carrier 2Y onto the transfer belt 3 over one cycle length of the transfer belt 3. Subsequently, the position shift sensor 25 detects positions of the pattern toner images to obtain position shift data. Further, first moving average values of n×N number of position shift data are calculated over at least one cycle of the transfer belt 3. Then, second moving average values of n×M number of the first moving average values are calculated.

Exemplary calculations of the first moving average values of n×N number of position shift data and the second moving average values of n×M number of the first moving average values by the center average method are represented below.

Assuming that n is 1, the ratio N:M is 4:3, position shift data are F1, F2, F3, F4 . . . FX, and a first moving average value is fma, the first moving average values of n×N number (e.g., 4) of position shift data are calculated over at least one cycle of the transfer belt 3 as follows.

$$fma3=(0.5\times F1+F2+F3+F4+0.5\times F5)/4$$

$$fma4=(0.5\times F2+F3+F4+F5+0.5\times F6)/4$$

$$fma5=(0.5\times F3+F4+F5+F6+0.5\times F7)/4$$

$$fma6=(0.5\times F4+F5+F6+F7+0.5\times F8)/4$$

$$fma7=(0.5\times F5+F6+F7+F8+0.5\times F9)/4$$

.

.

Then, assuming that a second moving average value is sma, the second moving average values of n×M number (e.g., 3) of the first moving average values are calculated over at least one cycle of the transfer belt 3 as follows.

$$sma2=(fma1+fma2+fma3)/3$$

$$sma3=(fma2+fma3+fma4)/3$$

$$sma4=(fma3+fma4+fma5)/3$$

$$sma5=(fma4+fma5+fma6)/3$$

$$sma6=(fma5+fma6+fma7)/3$$

.

.

By the above-described calculation, position shift data from which speed variation components of the image carrier and of the drive roller 4 are eliminated are calculated by a low-pass processing. By controlling the rotational speed of the drive roller 4 based on the calculated position shift data (i.e., the second moving average values . . . sma2, sma3, sma4, sma5, sma6 . . . ), the speed variation of the transfer belt 3 can be corrected. In the above exemplary calculation of the first moving average values of n×N number (e.g., 4) of position shift data by the center average method, 5 position shift data are divided by 4. However, because both end position shift data are reduced by one-half, respectively, the above-described 5 position shift data are considered as 4 position shift data in total. This applies to all cases when the n×N number is an even number.

After calculating moving average values of position shift data as described above, a rotational speed of a motor that drives the drive roller 4 to rotate is controlled based on the above-described calculated moving average values to correct the speed variation of the transfer belt 3 caused by the uneven thickness of the transfer belt 3 in its circumferential direction. By doing so, the speed variation of the transfer belt 3 caused by the uneven thickness of the transfer belt 3 can be canceled.

Figure 6:
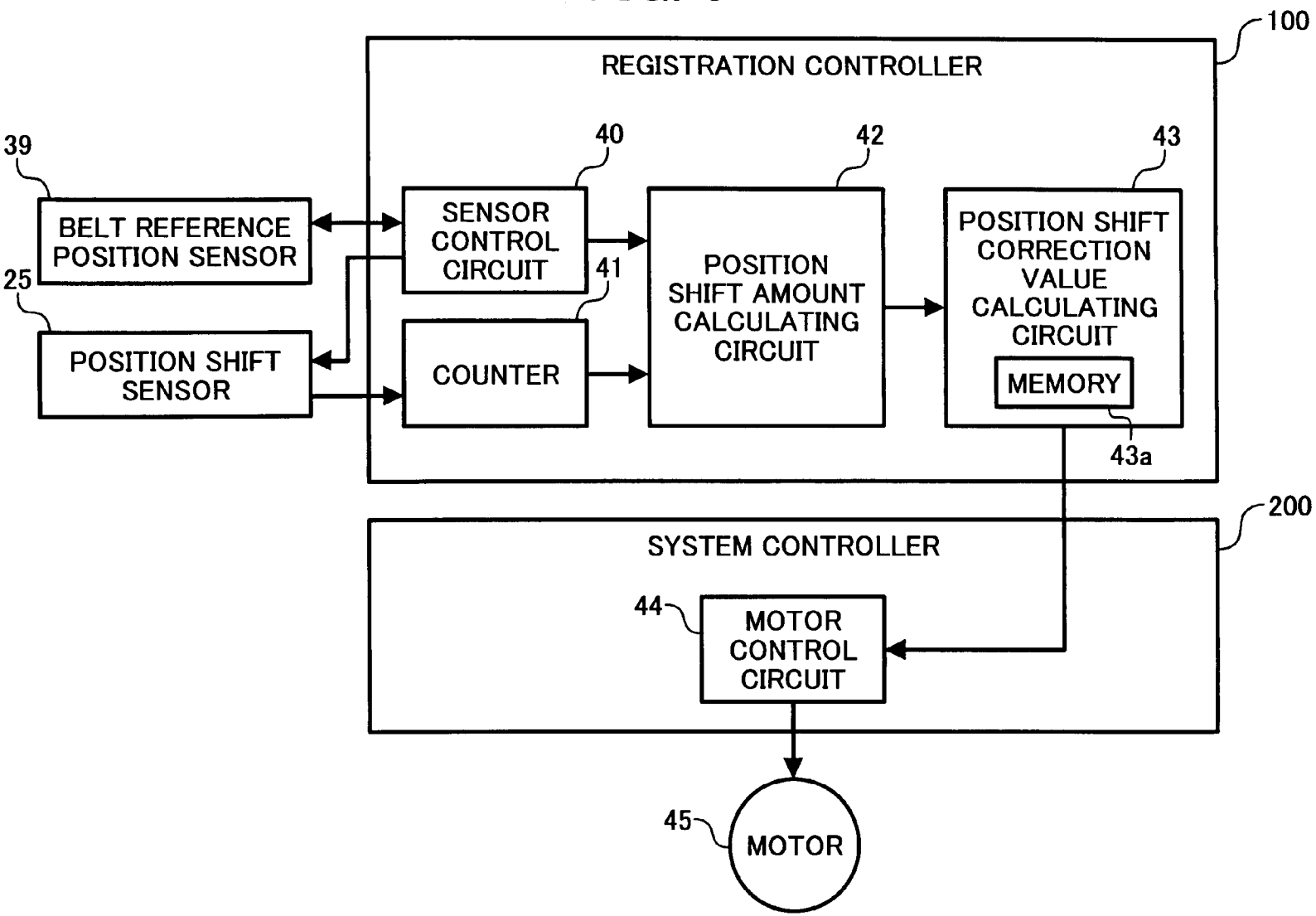
FIG. 6 is a block diagram of a control circuit that performs position shift detection and correction control operation.

FIG. 6 is a block diagram of a control circuit that performs position shift detection and correction control operation. A control circuit includes a registration controller 100 and a system controller 200. The registration controller 100 includes a sensor control circuit 40, a counter 41, a position shift amount calculating circuit 42, and a position shift correction value calculating circuit 43. The outputs of the sensor control circuit 40 and counter 41 are applied to the position shift amount calculating circuit 42. The sensor control circuit 40 controls the position shift sensor 25 which applies detection outputs to the counter 41. The position shift correction value calculating circuit 43 is also provided with a memory 43*a* for storing position shift correction values. The system controller 200 includes a motor control circuit 44.

As illustrated in FIG. 1, a belt reference position mark 60 is provided on the transfer belt 3, and a belt reference position sensor 39 is provided for detecting the belt reference position mark 60. Further, as described above, the position shift sensor 25 is provided for detecting the pattern toner images (PT). The belt reference position sensor 39 is connected to the registration controller 100. The belt reference position sensor 39 is controlled by the sensor control circuit 40, and the output of the belt reference position sensor 39 is applied to the sensor control circuit 40.

Pattern toner images are formed, for example, on the image carrier 2Y at the time the belt reference position sensor 39 detects the belt reference position mark 60 on the transfer belt 3. Subsequently, the pattern toner images are transferred from the image carrier 2Y onto the transfer belt 3. Then, the position shift sensor 25 detects positions of the pattern toner images (PT) on the transfer belt 3. An interval between detection outputs of the position shift sensor 25 is counted by the counter 41, and the position shift amount calculating circuit 42 calculates time intervals between the pattern toner images (PT), and calculates the amounts of position shifts of the pattern toner images (PT) from the time intervals to obtain position shift data of the pattern toner images (PT). Subsequently, the position shift amount calculating circuit 42 calculates moving average values of the position shift data by the above-described calculation. Further, the position shift correction value calculating circuit 43 calculates drive amount values (i.e., position shift correction values) for driving a motor 45 that drives the drive roller 4 based on the moving average values calculated by the position shift amount calculating circuit 42. The drive amount values for the motor 45 for driving the transfer belt 3 to rotate by one cycle are stored in the memory 43*a* of the position shift correction value calculating circuit 43.

The drive amount value data are transmitted to the motor control circuit 44 in the system controller 200. The motor control circuit 44 controls the motor 45 to drive based on the drive amount values calculated by the position shift correction value calculating circuit 43. Thereby, the drive roller 4 drives the transfer belt 3 to rotate based on the drive amount values with reference to the belt reference position mark 60 on the transfer belt 3. With the position shift detection and correction control operation by the registration controller 100 and the system controller 200, the drive motor 4 drives the transfer belt 3 to rotate while avoiding the speed variation of the transfer belt 3 caused by the uneven thickness of the transfer belt 3.

In the above-described position shift detection and correction control operation, the motor control circuit 44 controls the motor 45 based on the drive amount values calculated by the position shift correction value calculating circuit 43 to eliminate the speed variation of the transfer belt 3 caused by the uneven thickness of the transfer belt 3. Alternatively, the position shift correction value calculating circuit 43 may calculate position shift correction values for controlling image writing positions into the image carriers 2Y, 2C, 2M, 2BK by the laser writing device 8. In this case, the speed variation of the transfer belt 3 caused by the uneven thickness of the transfer belt 3 is avoided while controlling the laser writing device 8 to emit laser beams (L) to corrected positions on the circumferential surfaces of the image carriers 2Y, 2C, 2M, 2BK.

Although descriptions are omitted here, the image carriers 2Y, 2C, 2M, 2BK and the drive roller 4 are controlled such that their speed variations are eliminated.

The above-described moving average values may be calculated before the start of use of the transfer belt 3, for example, before shipment of the image forming apparatus. If the above-described position shift detection and correction control operation is performed to correct the speed variation of the transfer belt 3 before shipment of the image forming apparatus, the speed of the transfer belt 3 need not be measured every image forming operations. In this case, the control operation of the image forming apparatus can be simplified.

When an image forming apparatus is used for a relatively long time by a user, the thickness condition of a transfer belt may change during use. In this case, it is preferable that the above-described moving average values be calculated every time the number of image forming operations exceeds a predetermined number, and the position shift detection and correction control operation be performed.

Figure 7:
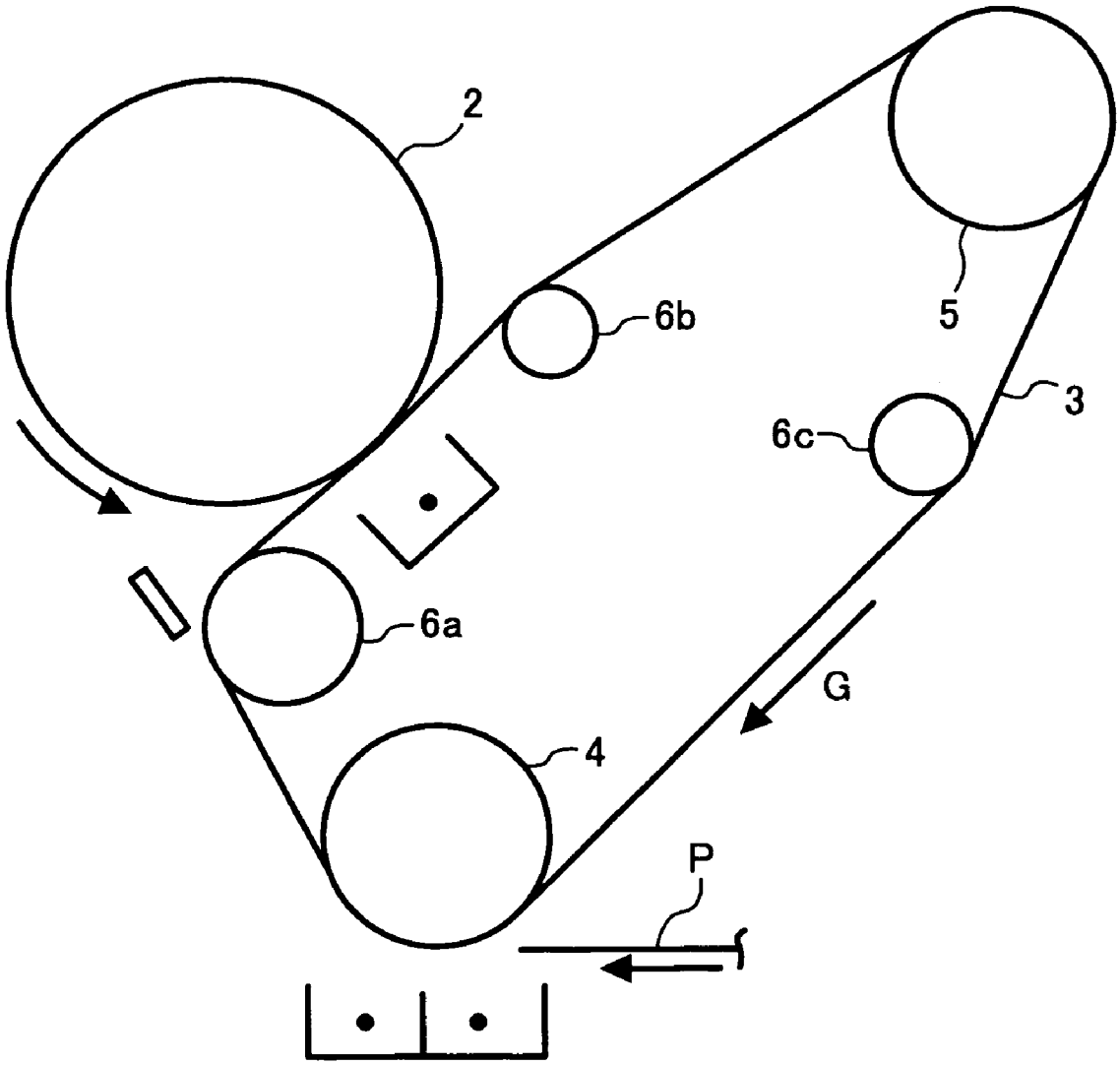
FIG. 7 is a schematic view of an image forming apparatus according to another embodiment.

The above-described position shift detection and correction control operation may be applied to any image forming apparatus, including those having a structure different from that of the image forming apparatus of FIG. 1. FIG. 7 illustrates another example of an image forming apparatus. In the image forming apparatus of FIG. 7, a yellow toner image, a cyan toner image, a magenta toner image, and a black toner image are sequentially formed on an image carrier 2 formed from a photoreceptor, and are sequentially transferred from the image carrier 2 onto the transfer belt 3 while being each superimposed thereon. The transfer belt 3 is spanned around and surrounds the drive roller 4, the driven roller 5, and driven rollers 6*a*, 6*b*, and 6*c*, and is rotated in a direction indicated by arrow (G). Then, a superimposed color toner image is transferred from the transfer belt 3 to a recording medium (P) and is fixed thereon by a fixing device (not shown).

Figure 8:
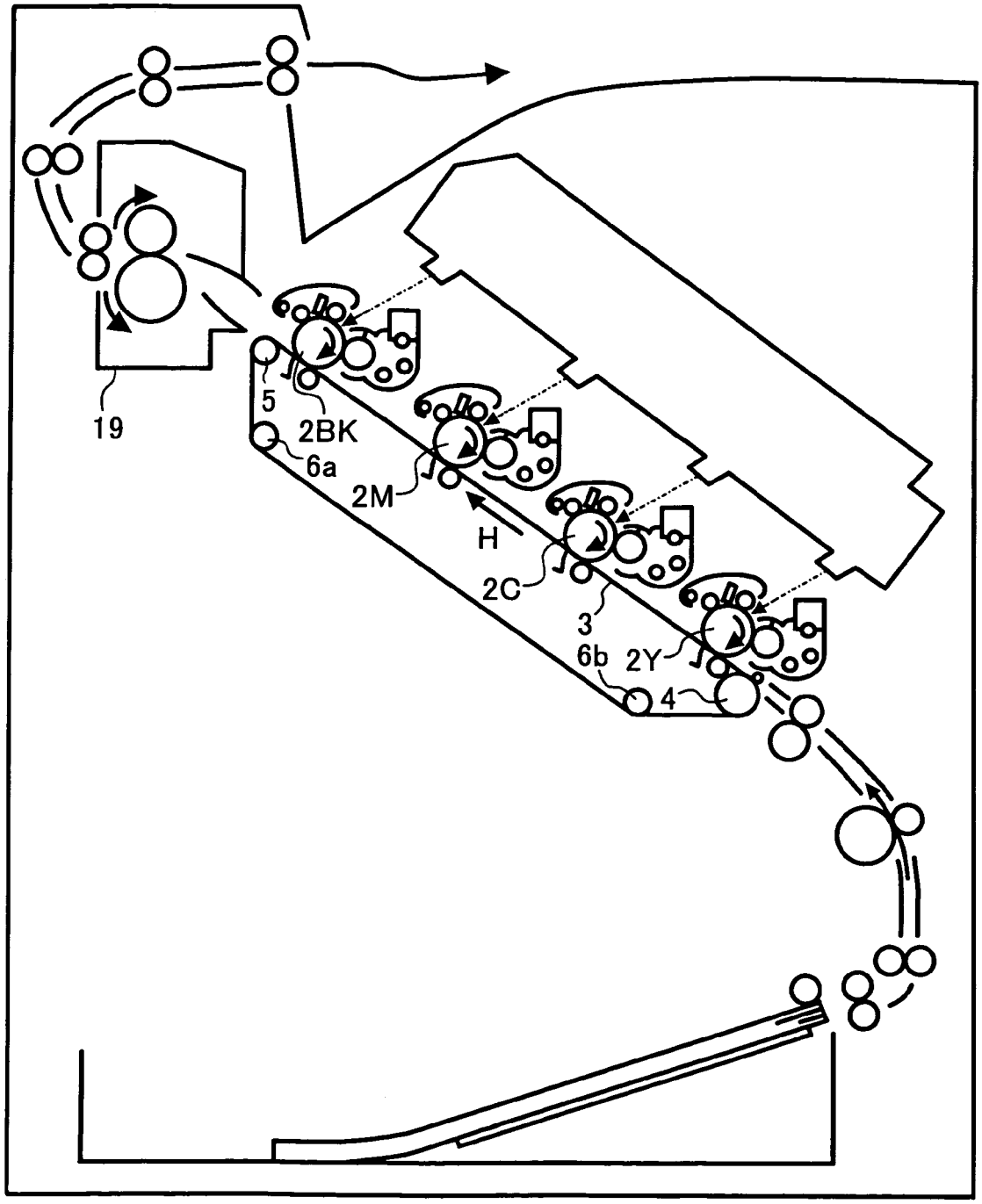
FIG. 8 is a schematic view of an image forming apparatus according to another embodiment.

Further, the above-described position shift detection and correction control operation may be applied to an image forming apparatus illustrated in FIG. 8. In the image forming apparatus of FIG. 8, a yellow toner image, a cyan toner image, a magenta toner image, and a black toner image are formed on the image carriers 2Y, 2C, 2M, 2BK, respectively, and are sequentially transferred from the image carriers 2Y, 2C, 2M, 2BK onto a recording medium carried and conveyed by the transfer belt 3 while being each superimposed thereon. The transfer belt 3 is spanned around and surrounds the drive roller 4, the driven rollers 5, 6*a*, and 6*b*, and is rotated in a direction indicated by arrow (H). The superimposed color toner image is fixed to the recording medium in the fixing device 19.

Among the image forming apparatuses of FIGS. 1, 7, and 8, the transfer belt 3 in the image forming apparatuses of FIGS. 1 and 7 receives color toner images directly from the image carriers. The transfer belt 3 in the image forming apparatus of FIG. 8 receives color toner images indirectly (i.e., via a recording medium) from the image carriers. The present invention can be applied to all these types of the image forming apparatuses.

According to the embodiments of the present invention, a position shift in a color toner image formed on a transfer belt or a recording medium can be detected in a simple manner and corrected according to an uneven thickness of the transfer belt. As a result, a high quality image without a color shift can be obtained. Further, the manufacturing tolerance for the belt thickness need not strictly be managed, and manufacturing costs can be reduced.

The present invention has been described with respect to the exemplary embodiments illustrated in the figures. However, the present invention is not limited to these embodiments and may be practiced otherwise.

In the above-described embodiments, pattern toner images are formed on the image carrier 2Y and are transferred from the image carrier 2Y onto the transfer belt 3. However, pattern toner images may be formed on any of the image carriers 2Y, 2C, 2M, 2BK.

The present invention has been described with respect to a digital copying machine as an example of an image processing apparatus. However, the present invention may be applied to other similar image processing apparatuses, such as, a facsimile machine, an image filing apparatus, a scanner, etc.

Numerous additional modifications and variations of the present invention are possible in light of the above teachings. It is therefore understood that within the scope of the appended claims, the present invention may be practiced other than as specifically described herein.

What is claimed is:

1. An image forming apparatus, comprising:

at least one image carrier configured to carry toner images and pattern toner images thereon;

an endless transfer belt configured to one of directly and indirectly receive the toner images and the pattern toner images from the at least one image carrier, the transfer belt being spanned around a drive roller that drives the transfer belt to rotate and at least one driven roller; and a position shift detector configured to detect positions of pattern toner images formed on the at least one image carrier, wherein assuming that "N" is an integer equal to or greater than 1, pattern toner images are formed on the at least one image carrier at an interval of "1/N" of a circumferential length of the at least one image carrier, and the pattern toner images are transferred from the at least one image carrier onto the transfer belt over one cycle length of the transfer belt, wherein the position shift detector detects positions of the pattern toner images to obtain position shift data, and wherein moving average values of "N" number of the position shift data are calculated, wherein the moving average values are calculated in one cycle length of the transfer belt with elimination of a speed variation component of the image carrier by low pass processing.

2. The image forming apparatus according to claim 1, wherein the moving average values of the "N" number of position shift data are calculated by a center average method.

3. The image forming apparatus according to claim 1, further comprising a control device configured to control a rotational speed of the drive roller based on the calculated moving average values to correct a speed variation of the transfer belt caused by an uneven thickness of the transfer belt in a circumferential direction of the transfer belt.

4. The image forming apparatus according to claim 1, wherein the moving average values are calculated before a start of use of the transfer belt.

5. The image forming apparatus according to claim 1, wherein the moving average values are calculated every time the number of image formations exceeds a predetermined number.

6. An image forming apparatus, comprising:

at least one image carrier configured to carry toner images and pattern toner images thereon;

an endless transfer belt configured to one of directly and indirectly receive the toner images and the pattern toner images from the at least one image carrier, the transfer belt being spanned around a drive roller that drives the transfer belt to rotate and at least one driven roller; and a position shift detector configured to detect positions of pattern toner images formed on the at least one image carrier, wherein assuming that "M" is an integer equal to or greater than 1, pattern toner images are formed on the at least one image carrier at an interval of "1/M" of a circumferential length of a circle having a diameter equal to a length in which an average thickness of the transfer belt is added to a diameter of the drive roller, and the pattern toner images are transferred from the at least one image carrier onto the transfer belt over one cycle length of the transfer belt, wherein the position shift detector detects positions of the pattern toner images to obtain position shift data, and wherein moving average values of "M" number of the position shift data are calculated, wherein the moving average values are calculated in one cycle length of the transfer belt with elimination of a speed variation component of the image carrier by low pass processing.

7. The image forming apparatus according to claim 6, wherein the moving average values of the "M" number of position shift data are calculated by a center average method.

8. The image forming apparatus according to claim 6, further comprising a control device configured to control a rotational speed of the drive roller based on the calculated moving average values to correct a speed variation of the transfer belt caused by an uneven thickness of the transfer belt in a circumferential direction of the transfer belt.

9. The image forming apparatus according to claim 6, wherein the moving average values are calculated before a start of use of the transfer belt.

10. The image forming apparatus according to claim 6, wherein the moving average values are calculated every time the number of image formations exceeds a predetermined number.

11. An image forming apparatus, comprising:

at least one image carrier configured to carry toner images and pattern toner images thereon;

an endless transfer belt configured to one of directly and indirectly receive the toner images and the pattern toner images from the at least one image carrier, the transfer belt being spanned around a drive roller that drives the transfer belt to rotate and at least one driven roller; and a position shift detector configured to detect positions of pattern toner images formed on the at least one image carrier, wherein assuming that each of "N", "M", and "n" is an integer equal to or greater than 1, a ratio between a circumferential length of the at least one image carrier and a circumferential length of a circle having a diameter equal to a length in which an average thickness of the transfer belt is added to a diameter of the drive roller is set to "N:M", pattern toner images are formed on the at least one image carrier at an interval of "1/n×N" of the circumferential length of the at least one image carrier, and the pattern toner images are transferred from the at least one image carrier onto the transfer belt over one cycle length of the transfer belt, wherein the position shift detector detects positions of the pattern toner images to obtain position shift data, and wherein first moving average values of "n×N" number of the position shift data are calculated, and then second moving average values of "n×M" number of the first moving average values are calculated, wherein at least one of the first and second moving average values is calculated in one cycle length of the transfer belt with elimination of a speed variation component of the image carrier by low pass processing.

12. The image forming apparatus according to claim 11, wherein the first and second moving average values are calculated by a center average method.

13. The image forming apparatus according to claim 11, further comprising a control device configured to control a rotational speed of the drive roller based on the calculated second moving average values to correct a speed variation of the transfer belt caused by an uneven thickness of the transfer belt in a circumferential direction of the transfer belt.

14. The image forming apparatus according to claim 11, wherein the first and second moving average values are calculated before a start of use of the transfer belt.

15. The image forming apparatus according to claim 11, wherein the first and second moving average values are calculated every time the number of image formations exceeds a predetermined number.

16. A position shift detection and correction method for detecting and correcting a position shift in a color toner image formed on one of a transfer belt and a recording medium carried and conveyed on the transfer belt according to an uneven thickness of the transfer belt, comprises:

forming pattern toner images on at least one image carrier at an interval of "1/N" of a circumferential length of the at least one image carrier, where "N" is an integer equal to or greater than 1;

transferring the pattern toner images from the at least one image carrier onto the transfer belt over one cycle length of the transfer belt;

detecting positions of the pattern toner images to obtain position shift data;

calculating moving average values of "N" number of the position shift data in one cycle length of the transfer belt with elimination of a speed variation component of the image carrier by low pass processing; and controlling a rotational speed of a drive roller that drives the transfer belt to rotate based on the calculated moving average values.

17. The position shift detection and correction method according to claim 16, wherein the calculating comprises calculating the moving average values of the "N" number of position shift data by a center average method.

18. The position shift detection and correction method according to claim 16, wherein the calculating comprises calculating the moving average values before a start of use of the transfer belt.

19. The position shift detection and correction method according to claim 16, wherein the calculating comprises calculating the moving average values every time the number of image formations exceeds a predetermined number.

20. A position shift detection and correction method for detecting and correcting a position shift in a color toner image formed on one of a transfer belt and a recording medium carried and conveyed on the transfer belt according to an uneven thickness of the transfer belt, comprises:

forming pattern toner images on at least one image carrier at an interval of "1/M" of a circumferential length of a circle having a diameter equal to a length in which an average thickness of the transfer belt is added to a diameter of a drive roller that drives the transfer belt to rotate, where "M" is an integer equal to or greater than 1;

transferring the pattern toner images from the at least one image carrier onto the transfer belt over one cycle length of the transfer belt; detecting positions of the pattern toner images to obtain position shift data;

calculating moving average values of "M" number of the position shift data in one cycle length of the transfer belt with elimination of a speed variation component of the image carrier by low pass processing; and controlling a rotational speed of the drive roller based on the calculated moving average values.

21. The position shift detection and correction method according to claim 20, wherein the calculating comprises calculating the moving average values of the "M" number of position shift data by a center average method.

22. The position shift detection and correction method according to claim 20, wherein the calculating comprises calculating the moving average values before a start of use of the transfer belt.

23. The position shift detection and correction method according to claim 20, wherein the calculating comprises calculating the moving average values every time the number of image formations exceeds a predetermined number.

24. A position shift detection and correction method for detecting and correcting a position shift in a color toner image formed on one of a transfer belt and a recording medium carried and conveyed on the transfer belt according to an uneven thickness of the transfer belt, comprising:

setting a ratio between a circumferential length of at least one image carrier and a circumferential length of a circle having a diameter equal to a length in which an average thickness of the transfer belt is added to a diameter of a drive roller that drives the transfer belt to rotate to "N:M" , where each of "N", "M" is an integer equal to or greater than 1;

forming pattern toner images on the at least one image carrier at an interval of "1/n×N" of the circumferential length of the at least one image carrier, where "n" is an integer equal to or greater than 1;

transferring the pattern toner images from the at least one image carrier onto the transfer belt over one cycle length of the transfer belt;

detecting positions of the pattern toner images to obtain position shift data;

calculating first moving average values of "n×N" number of the position shift data, and then calculating second moving average values of "n×M" number of the first moving average values, wherein at least one of the first and second moving average values is calculated in one cycle length of the transfer belt with elimination of a speed variation component of the image carrier by low pass processing; and controlling a rotational speed of the drive roller based on the calculated second moving average values.

25. The position shift detection and correction method according to claim 24, wherein the calculating comprises calculating the first and second moving average values by a center average method.

26. The position shift detection and correction method according to claim 24, wherein the calculating comprises calculating the first and second moving average values before a start of use of the transfer belt.

27. The position shift detection and correction method according to claim 24, wherein the calculating comprises calculating the first and second moving average values every time the number of image formations exceeds a predetermined number.

28. An image forming apparatus, comprising:

image carrying means for carrying toner images and pattern toner images thereon;

image receiving means for one of directly and indirectly receiving the toner images and the pattern toner images from the image carrying means, the image receiving means being spanned around drive means for driving the image receiving means to rotate and driven means for being driven by a rotation of the image receiving means; and position shift detecting means for detecting positions of pattern toner images formed on the image carrying means, wherein assuming that "N" is an integer equal to or greater than 1, pattern toner images are formed on the image carrying means at an interval of "1/N" of a circumferential length of the image carrying means, and the pattern toner images are transferred from the image carrying means onto the image receiving means over one cycle length of the image receiving means, wherein the position shift detecting means detects positions of the pattern toner images to obtain position shift data, and wherein moving average values of "N" number of the position shift data are calculated, wherein the moving average values are calculated in one cycle length of the image receiving means with elimination of a speed variation component of the image carrying means by low pass processing.

29. The image forming apparatus according to claim 28, further comprising control means for controlling a rotational speed of the drive means based on the calculated moving average values to correct a speed variation of the image receiving means caused by an uneven thickness of the image receiving means in a circumferential direction of the image receiving means.

30. An image forming apparatus, comprising:

image carrying means for carrying toner images and pattern toner images thereon;

image receiving means for one of directly and indirectly receiving the toner images and the pattern toner images from the image carrying means, the image receiving means being spanned around drive means for driving the image receiving means to rotate and driven means for being driven by a rotation of the image receiving means; and position shift detecting means for detecting positions of pattern toner images formed on the image carrying means, wherein assuming that "M" is an integer equal to or greater than 1, pattern toner images are formed on the image carrying means at an interval of "1/M" of a circumferential length of a circle having a diameter equal to a length in which an average thickness of the image receiving means is added to a diameter of the drive means, and the pattern toner images are transferred from the image carrying means onto the image receiving means over one cycle length of the image receiving means, wherein the position shift detecting means detects positions of the pattern toner images to obtain position shift data, and wherein moving average values of "M" number of the position shift data are calculated, wherein the moving average values are calculated in one cycle length of the image receiving means with elimination of a speed variation component of the image carrying means by low pass processing.

31. The image forming apparatus according to claim 30, further comprising control means for controlling a rotational speed of the drive means based on the calculated moving average values to correct a speed variation of the image receiving means caused by an uneven thickness of the image receiving means in a circumferential direction of the image receiving means.

32. An image forming apparatus, comprising:

image carrying means for carrying toner images and pattern toner images thereon;

image receiving means for one of directly and indirectly receiving the toner images and the pattern toner images from the image carrying means, the image receiving means being spanned around drive means for driving the image receiving means to rotate and driven means for being driven by a rotation of the image receiving means; and position shift detecting means for detecting positions of pattern toner images formed on the image carrying means, wherein assuming that each of "N", "M", and "n" is an integer equal to or greater than 1, a ratio between a circumferential length of the image carrying means and a circumferential length of a circle having a diameter equal to a length in which an average thickness of the image receiving means is added to a diameter of the drive means is set to "N:M", pattern toner images are formed on the image carrying means at an interval of "1/n×N" of the circumferential length of the image carrying means, and the pattern toner images are transferred from the image carrying means onto the image receiving means over one cycle length of the image receiving means, wherein the position shift detecting means detects positions of the pattern toner images to obtain position shift data, and wherein first moving average values of "n×N" number of the position shift data are calculated, and then second moving average values of "n×M" number of the first moving average values are calculated, wherein at least one of the first and second moving average values is calculated in one cycle length of the image receiving means with elimination of a speed variation component of the image carrying means by low pass processing.

33. The image forming apparatus according to claim 32, further comprising control means for controlling a rotational speed of the drive means based on the calculated second moving average values to correct a speed variation of the image receiving means caused by an uneven thickness of the image receiving means in a circumferential direction of the image receiving means.

* * * * *